US009251768B2

(12) United States Patent
Lionello

(10) Patent No.: US 9,251,768 B2
(45) Date of Patent: Feb. 2, 2016

(54) SHOULDER STRAP OPERATED PITCH CHANGING MEANS FOR STRINGED INSTRUMENTS

(71) Applicant: Scott Nicholas Dante Lionello, Tsawwassen (CA)

(72) Inventor: Scott Nicholas Dante Lionello, Tsawwassen (CA)

( * ) Notice: Subject to any disclaimer, the term of this patent is extended or adjusted under 35 U.S.C. 154(b) by 0 days.

(21) Appl. No.: 14/323,321

(22) Filed: Jul. 3, 2014

(65) Prior Publication Data

US 2015/0007705 A1 Jan. 8, 2015

Related U.S. Application Data

(60) Provisional application No. 61/843,119, filed on Jul. 5, 2013.

(51) Int. Cl.
*G10D 3/14* (2006.01)

(52) U.S. Cl.
CPC ..... *G10D 3/143* (2013.01)

(58) Field of Classification Search
CPC ..... G10D 3/143
See application file for complete search history.

(56) References Cited

U.S. PATENT DOCUMENTS

| | | | | | |
|---|---|---|---|---|---|
| 2,201,536 | A * | 5/1940 | Ellison | | 84/312 R |
| 2,949,806 | A | 8/1960 | Turman | | |
| 3,479,917 | A | 11/1969 | Zitnik, Jr. | | |
| 3,512,443 | A * | 5/1970 | Parson et al. | | 84/313 |
| 3,686,993 | A * | 8/1972 | Fender | | 84/312 R |
| 3,721,150 | A * | 3/1973 | Hoffman et al. | | 84/313 |
| 3,990,341 | A * | 11/1976 | Pace, Sr. | | 84/313 |
| 4,354,417 | A * | 10/1982 | Glaser, II | | 84/312 R |
| 4,535,670 | A * | 8/1985 | Borisoff | | 84/312 R |
| 4,610,190 | A * | 9/1986 | Maloney | | 84/312 R |
| 5,140,884 | A * | 8/1992 | Bowden | G10D 3/14 | 84/297 R |
| 5,442,987 | A * | 8/1995 | Davis | | 84/312 R |
| 5,481,954 | A | 1/1996 | Parsons | | |
| 5,542,330 | A * | 8/1996 | Borisoff | | 84/298 |
| 5,567,897 | A * | 10/1996 | McEwen | | 84/312 R |
| 5,585,580 | A * | 12/1996 | Higgins | G10D 3/14 | 84/304 |
| 5,796,020 | A * | 8/1998 | Truitt | | 84/266 |
| 7,329,808 | B2 * | 2/2008 | Davis | | 84/313 |
| 7,696,420 | B2 * | 4/2010 | Thompson | G10D 3/146 | 84/173 |
| 8,288,637 | B2 * | 10/2012 | Kingsley | G10D 1/02 | 84/312 P |
| 9,076,412 | B1 | 7/2015 | Rolling | | |
| 2013/0180378 | A1 | 7/2013 | Baker | | |
| 2014/0196590 | A1 | 7/2014 | Alford | | |
| 2015/0007705 | A1 * | 1/2015 | Lionello | | 84/298 |

OTHER PUBLICATIONS

Product: McVay Single Bender Produced by: McVay Benders, c/o Charlie McVay, 681 Hartzell School Rd., New Brighton, PA 15066-4249 http://mcvaybenders.com/benders-single/.

Product B and G String Benders Produced by: Forrest Custom Guitars, c/o Waverly Music and Computer, 112 N Church St., Waverly TN 37185 http://www.forrestcustomguitars.com/.

Product: B & G String Benders Produced by: Tim Wallis, Timara Custom Shop, PO Box 54, Warrensburg IL 62573 US http://www.timarastringbenders.com/product_p/benders.htm.

* cited by examiner

*Primary Examiner* — Robert W Horn

(57) ABSTRACT

The present invention relates to a method and apparatus for changing the pitch of a string or strings of a string instrument.

24 Claims, 8 Drawing Sheets

SHOULDER STRAP OPERATED PITCH CHANGING MEANS FOR STRINGED INSTRUMENTS

CROSS REFERENCE TO RELATED APPLICATIONS

This application claims priority from U.S. Provisional Patent Application Ser. No. 61/843,119 filed on Jul. 5, 2013, entitled "Shoulder Strap Operated Pitch Changing Means For Stringed Instruments", which is expressly incorporated by reference herein to the extent permitted by law.

BACKGROUND OF THE INVENTION

1. Field of the Invention

The present invention relates to supplemental devices for musical instruments, and more particularly string instruments, and more particularly guitars.

2. Description of Related Art

Apparatuses that provide a means to change the pitch of a string or strings on acoustic and electric guitars (herein referred to as string benders) have been an integral part of numerous genres of music for more than 40 years. They have been particularly popular among country and western guitarists as they allow the player to emulate the effect of a pedal steel style guitar on a standard instrument.

A string bender is an apparatus that features one or more levers that usually attach to the B and/or G strings of a guitar at the bridge, allowing their pitch to be raised and lowered without the use of the guitarist's fretting fingers. They commonly feature a spring or other tensioning device that adds resistance to the system to allow the device to return to its neutral position reliably. The guitarist uses a lever, usually on top of the guitar's body, or attached to the top or bottom of a guitar strap to affect the pitch of the notes being played. The player can quickly vary the tension of the active string (or strings) to create bending effects that simulate the function of a pedal steel guitar.

A string bender was invented by Gene V. Parson and Clarence J. White as documented in U.S. Pat. No. 3,512,443 issued May 19, 1970, titled Shoulder Strap Control for String Instruments. Since that time, all such devices and improvements thereof have exhibited some or all of the following inherent flaws:

- The devices mechanism resides in or passes through the body of the instrument. Such devices require extensive modification to the body in order to be installed. These modifications are achieved by means of drilling and or routing with little to no tolerance for error. Installation of such devices is commonly performed by professional technicians and is costly, often more costly that the device itself.
- The devices operate by using a lever actuated by the guitarist's picking hand.
- The devices require holes to be drilled into the guitar's body, The high purchase cost of existing devices, coupled with the cost and extensiveness of modifications required for their use has placed the benefits of string benders out of reach of many guitarists.

Accordingly, what is needed is a better way to achieve the full effect of a strap controlled string bender without requiring extensive modification to a guitar's body and that can be removed from a guitar's body having left no indication of its presence.

SUMMARY OF THE INVENTION

The present invention is directed to this need. According to one aspect of the present invention, there is provided an apparatus, mountable to string instrument, for providing a means to change the pitch of a string or strings on acoustic and electric guitars, without an action of the user's fretting fingers, the apparatus having a first lever connected to a guitar strap or other point of attachment and to a means of transferring motion to a second lever, operable to transfer motion from the guitar strap to the means of transferring motion to a second lever, and a second lever attached to a means of transferring motion to said second lever and to a guitar string or strings, operable to transfer motion from a means of transferring motion to the second lever to the guitar string or strings. There is provided a tensioning device or devices, operable to cause the levers to return to a neutral position when not in use.

The apparatus might include a plate or plates wherein the first lever and the second lever are attached on the plate or plates. In this regard, the first lever and the second lever operate above the surface of the plate and as such above the surface of a string instrument. The plate or plates may be affixed to the body of a string instrument by utilizing only existing holes in a string instrument, or may be affixed to a string instrument utilizing holes that must be added to a string instrument.

Further aspects and advantages of the present invention will become apparent upon considering the following drawings, and description.

DESCRIPTION OF THE INVENTION

DETAILED DESCRIPTION OF A SPECIFIC EMBODIMENT OF THE PRESENT INVENTION

Structure of a Specific Embodiment of the Invention

Figure 1:
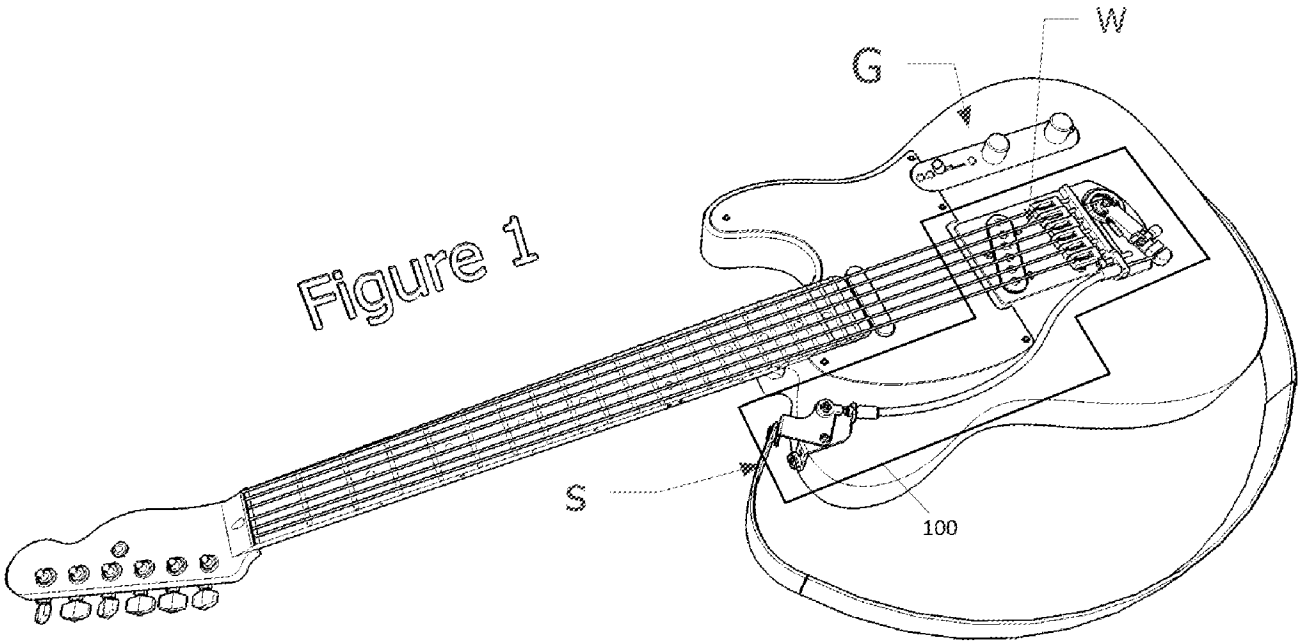
FIG. 1 is a perspective view of a shoulder strap controlled pitch changing means for stringed instruments according to an embodiment of the present invention.
Figure 2:
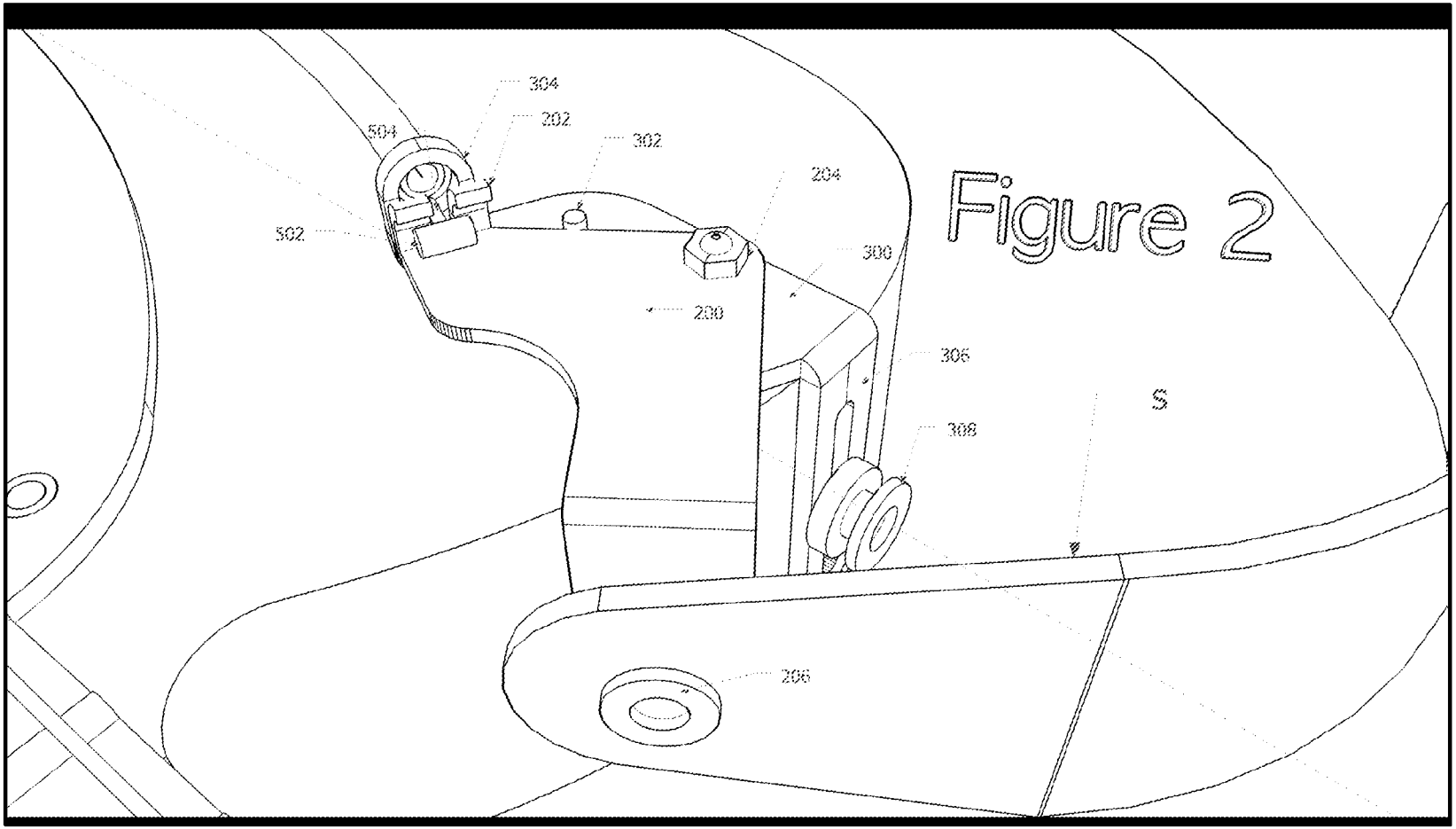
FIG. 2 is a perspective view of a shoulder strap controlled pitch changing means for stringed instruments according to an embodiment of the present invention.
Figure 3:
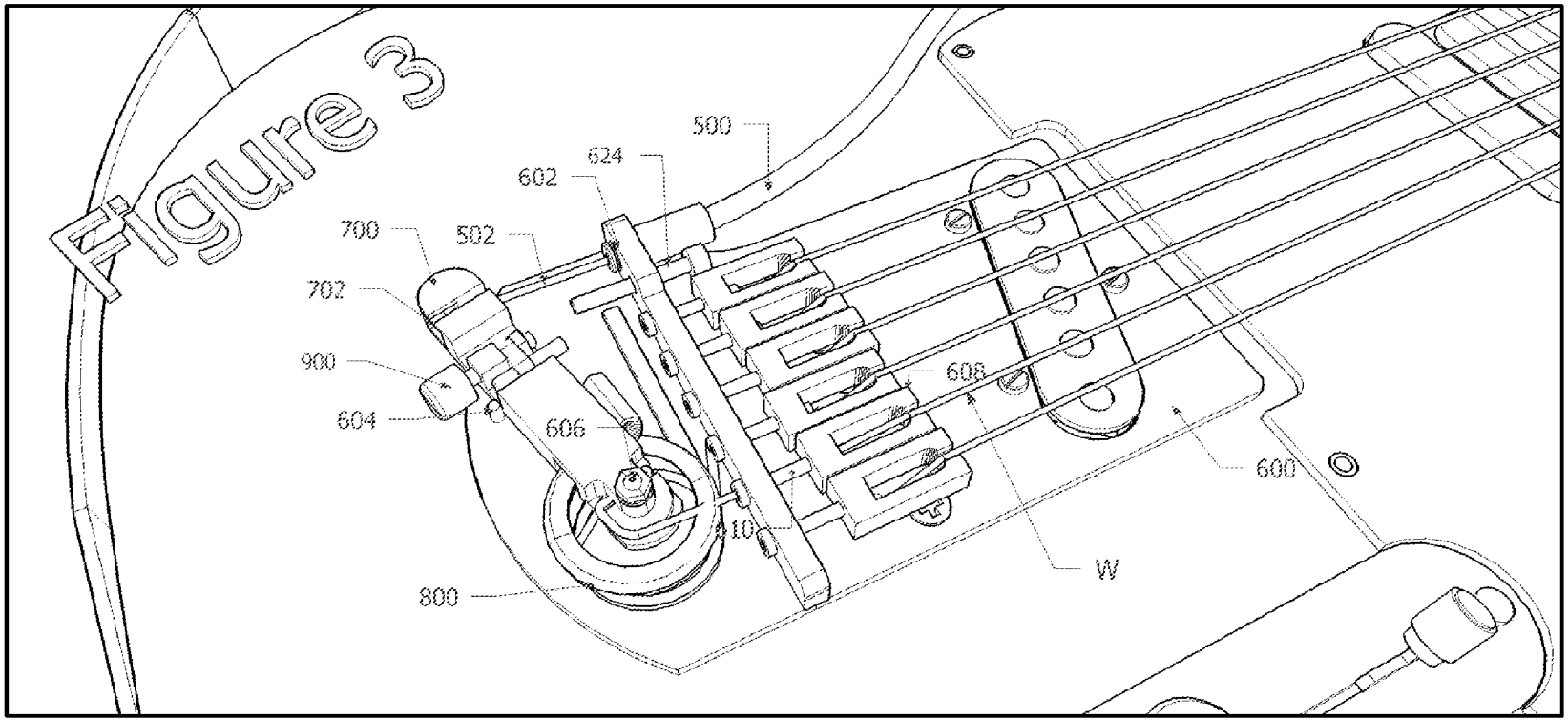
FIG. 3 is a perspective view of a shoulder strap controlled pitch changing means for stringed instruments according to an embodiment of the present invention.
Figure 4:
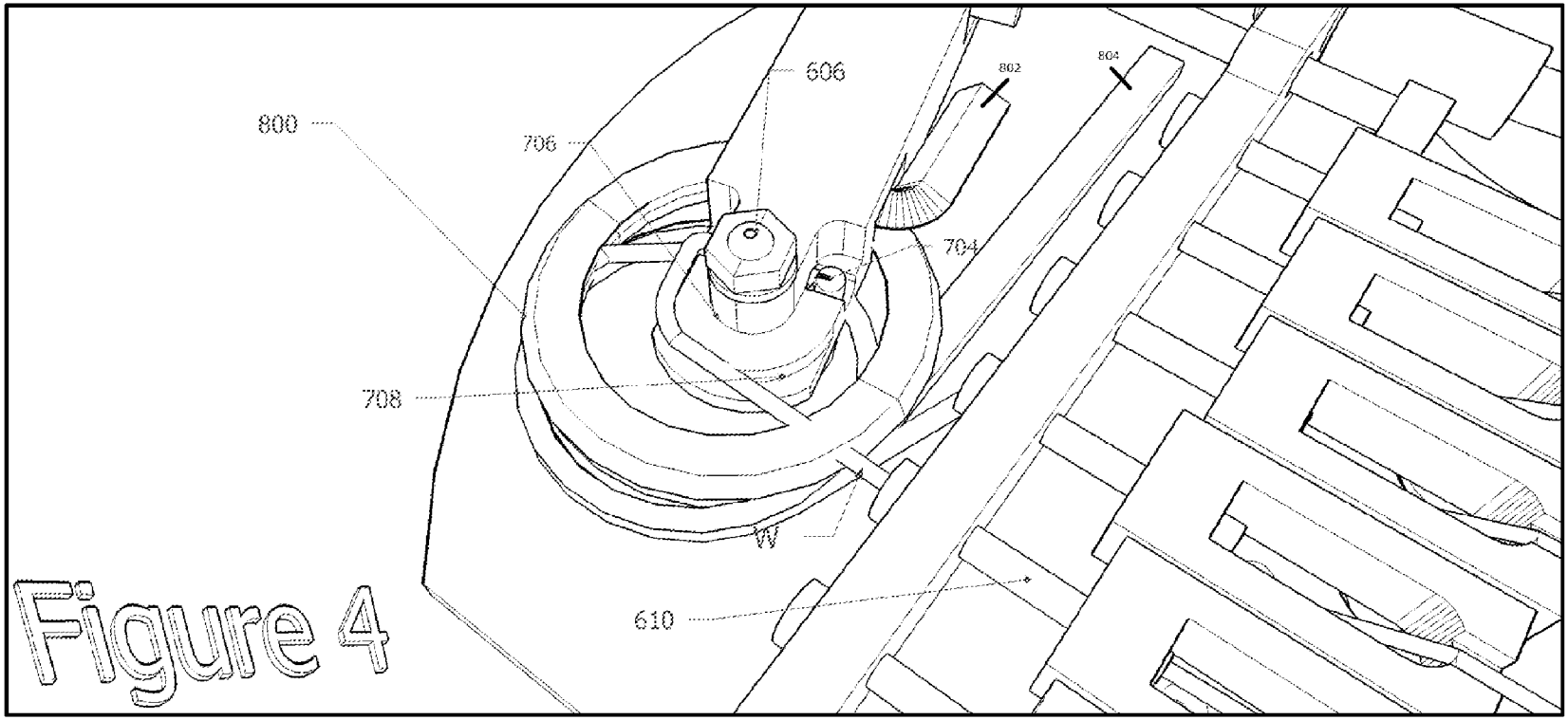
FIG. 4 is a perspective view of a shoulder strap controlled pitch changing means for stringed instruments according to an embodiment of the present invention.
Figure 5:
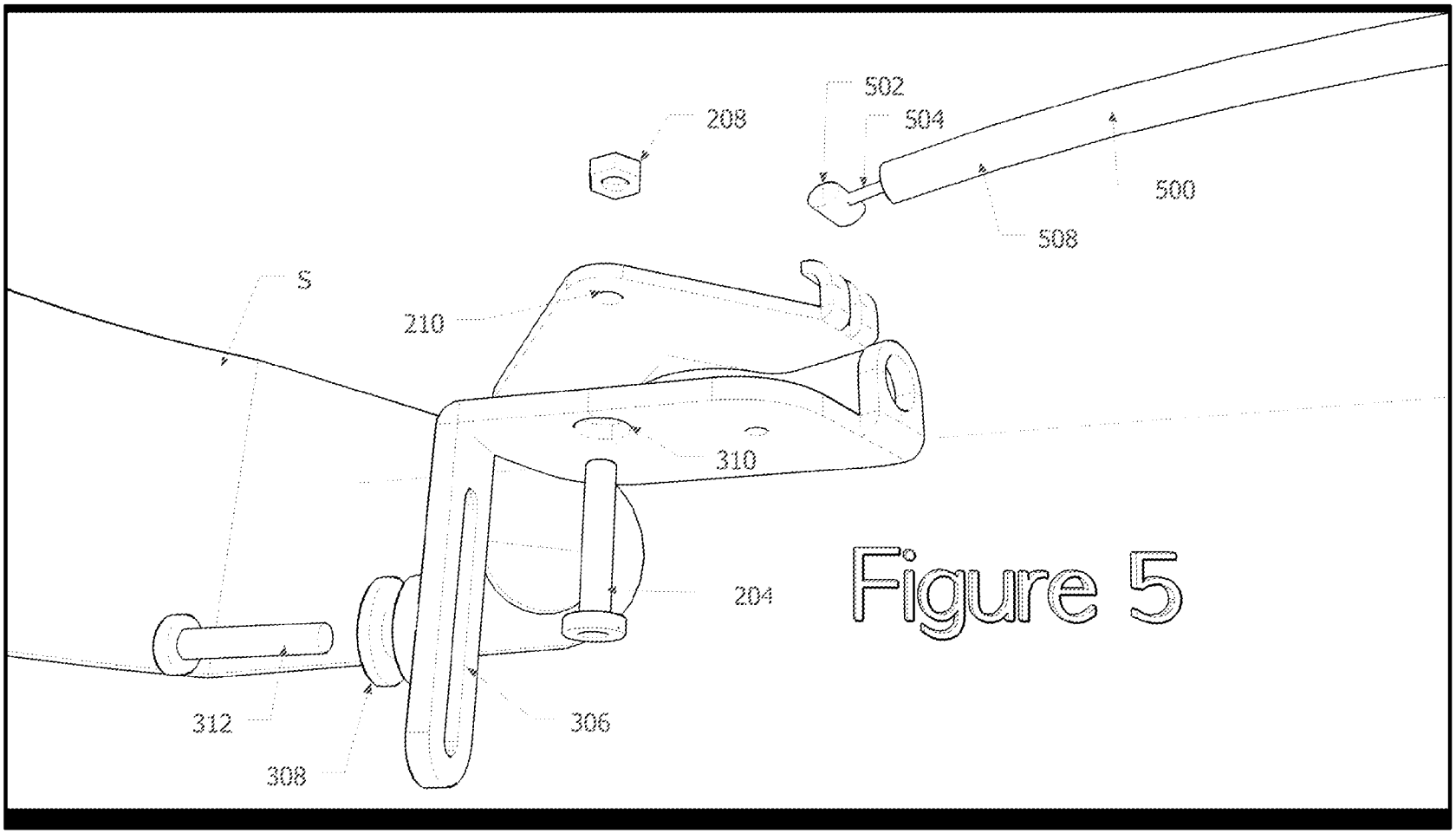
FIG. 5 is a perspective exploded view of a shoulder strap controlled pitch changing means for stringed instruments according to an embodiment of the present invention.
Figure 6:
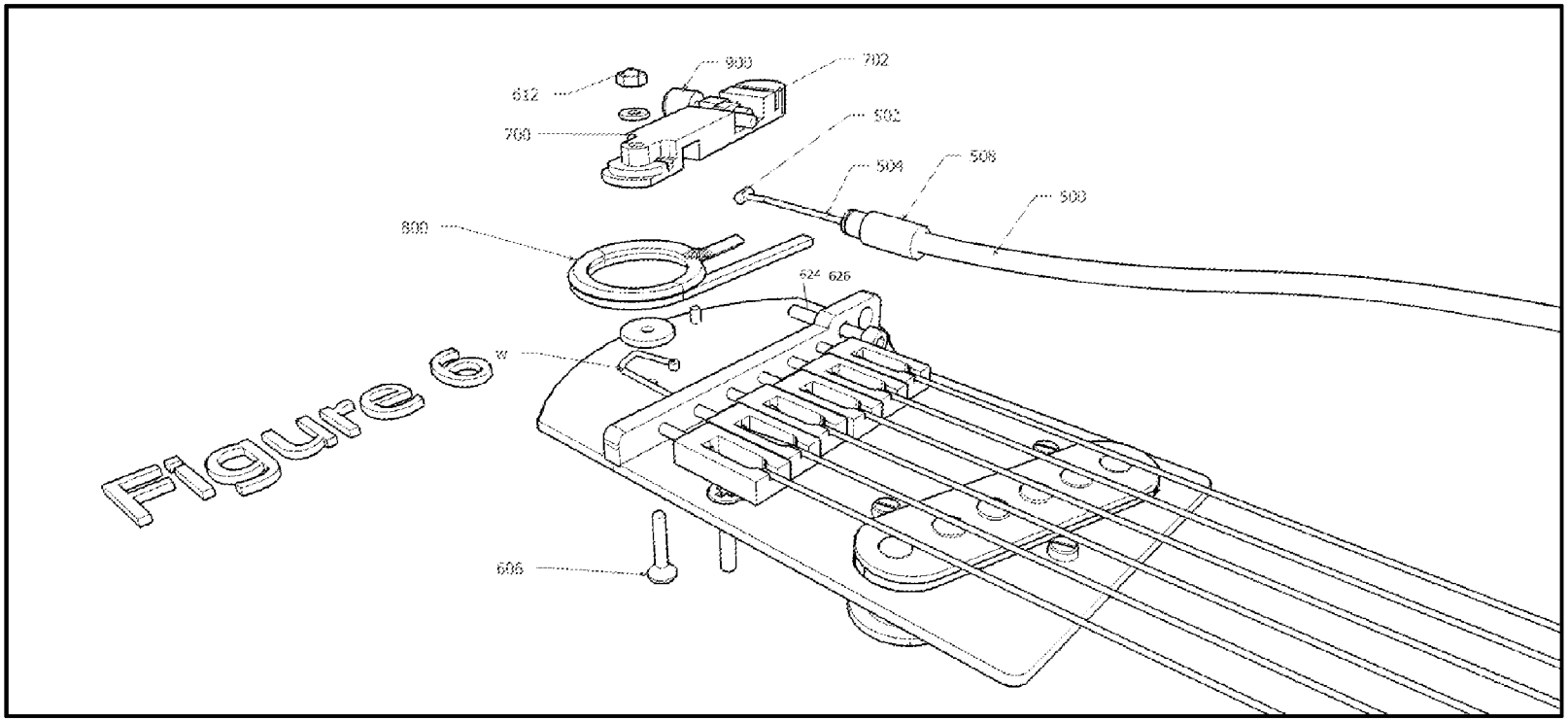
FIG. 6 is a perspective exploded view of a shoulder strap controlled pitch changing means for stringed instruments according to an embodiment of the present invention.
Figure 7:
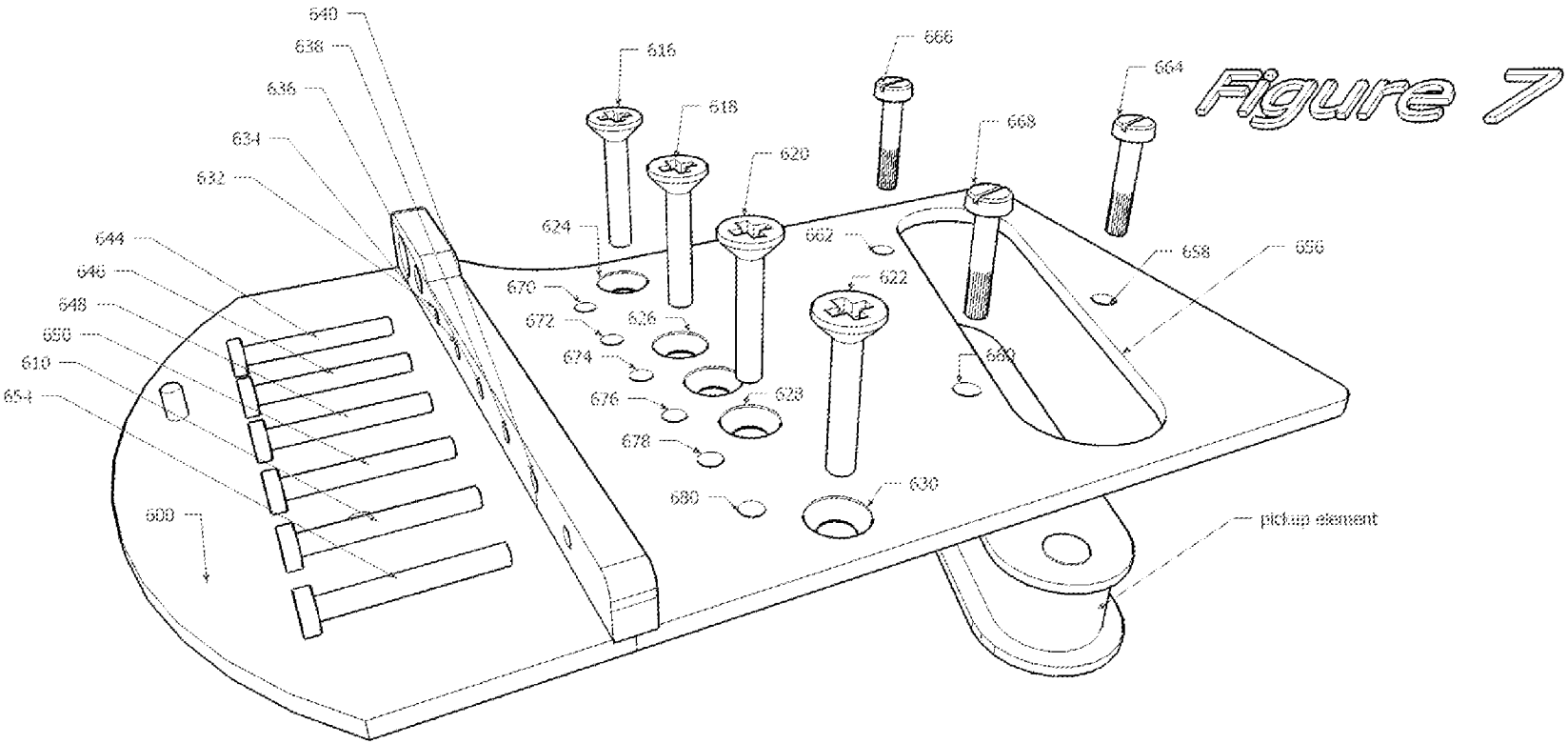
FIG. 7 is a perspective exploded view of a shoulder strap controlled pitch changing means for stringed instruments according to an embodiment of the present invention.
Figure 8:
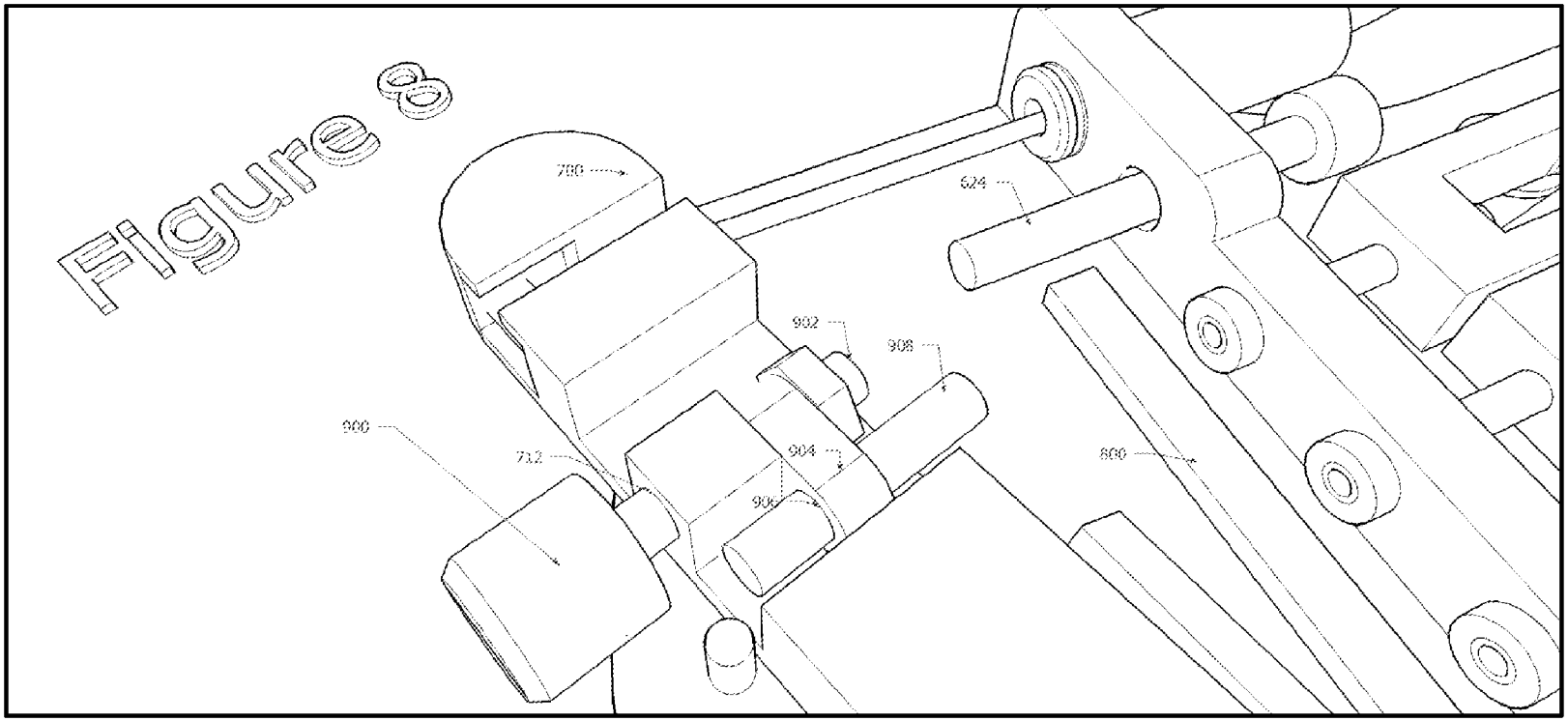
FIG. 8 is a perspective view of a shoulder strap controlled pitch changing means for stringed instruments according to an embodiment of the present invention.

Describing a specific embodiment of the invention now, FIGS. 1, 2, 3, 4, 5, 6, 7, and 8 show a shoulder strap controlled pitch changing means for stringed instruments 100 having an upper lever 200 affixed to an upper baseplate 300 connected to a lower lever 700 affixed to a lower baseplate 600 by a means for transferring motion 500, in this case a control cable assembly.

The upper lever 200 is connected to the upper baseplate 300 by a bolt 204 and secured by nut 208. More particularly, the upper baseplate 300 has a hole 310 that is flat countersunk to accept the flat head of the bolt 204, while the upper lever 200 has an unthreaded hole 210, sized to slidably accept portions of the bolt 204. The upper lever 200 is connected to strap S by a strap retention device 206, which may be attached to the upper lever 200 by a bolt or may be attached by a weld or adhesive substance. The upper lever 200 is attached to cable 504 within cable assembly 500 by a hook 202 retaining cable barrel end 502.

The upper baseplate 300 is attached to guitar G by a bolt 312 which passes through a hole in strap retention device 308, sized to slidably accept a shank portion of bolt 312 wile abutting the head portion of bolt 312 and passes through an elongated hole 306, sized to slidably accept shank portions of bolt 312. The cable assembly 500 is attached to the upper lever 300 by a hole 304, sized to slidably accept the end of cable conduit 508. The upper baseplate 300 has vertical stopper 302 which sets the resting position of the upper lever 200.

The lower lever 700 is connected to the lower baseplate 600 by a bolt 606 and secured by nut 612. More particularly, the lower baseplate 600 has a hole 614 that is flat countersunk to accept the flat head of the bolt 606, while the lower lever 700 has an unthreaded hole 710, sized to slidably accept portions of the bolt 606. The lower lever 700 is connected to cable 504 by a cavity 702, sized to slidably accept barrel end 502, located a distance from the fulcrum of lower lever 700 sufficient to provide a ratio of leverage upon string W. String W is attached to the lower lever 700 by a hole 704, sized to slidably accept wire portions of string W, but to abut barrel end sections. String W wraps around channel 706 and passes through hollow bolt 610, sized to slidably accept wire portions of string W and passes over saddle 608 and from there interacts with guitar G as would a string on a standard guitar. String W may alternatively wrap around channel 708 thus extending further from the fulcrum of lower lever 700, consequently achieving lesser mechanical advantage.

The lower baseplate 600 is attached to guitar G by bolts 616, 618, 620, and 622, which pass through holes 624, 626, 628, and 630 sized to slidably accept shank portions of bolts 616, 618, 620, and 622, and countersunk to abut head portions of bolts 616, 618, 620, and 622. The cable assembly 500 is attached to the lower baseplate 600 by a hole 602, which is sized to slidably accept the end of control cable conduit 508. The lower baseplate 600 has vertical stopper 604 which sets the resting position of the lower lever 700. There is provided a tensioner, in this embodiment torsion spring 800, which interacts with lower lever 700 with arm 802 and lower baseplate 600 with arm 804. There is provided a tuning bolt 624. Tuning bolt 624 is attached to lower baseplate 600 by a hole 626, located adjacent to hole 602 and sized to threadably accept shank portions of tuning bolt 624. Tuning bolt 624 is operable to tuneably impede the travel of lower lever 700, thus impeding the continued tensioning of string W, thus setting the upper pitch at-which string W will arrive when the string bender apparatus is actuated fully.

The lower baseplate 600 also includes holes 632, 634, 636, 638, 640, and 642, sized to slidably accept skank portion of intonation bolts 644, 646, 648, 650, 610, and 654, operable to cause lower baseplate 600 to function as a bridge assembly for string instruments. Lower baseplate 600 includes holes 670, 672, 674, 676, 678, and 680, operable to slidably accept portions of string instrument strings. Lower baseplate 600 includes hole 656, sized to slidably accept portions of a pickup element. Lower baseplate 600 further includes holes 658, 660, and 662, sized to slidably accept shank portions of pickup element mounting bolts 664, 666, and 668, operable to adjustably mount said pickup element to lower baseplate 600.

There is provided an interval switching device 900, rotatably attached to lower lever 700 by hole 712, sized to slidably accept shank portions of thumbscrew 902, and abut head portions thereof. Thumbscrew 902 is threadably attachable to plate 904 by hole 906, which is sized to threadably accept shank portions of thumbscrew 902. Tuning screw 908 is threadably attached to plate 904 by hole 910 which is sized to threadably accept shank portions of tuning screw 908. Interval switching device 900 is operable to selectively move tuning screw 908 into and out of the intervening space between lower lever 700 and tuning bolt 624, and thus is operable to further selectively impede the travel of lower lever 700, thus impeding the continued tensioning of string W, thus setting an alternative upper pitch at-which string W will arrive when the string bender apparatus is actuated fully.

In more detail, upper lever 200, upper baseplate 300, lower baseplate 600, and lower lever 700 are sufficiently wide tall and deep to fit onto and function on a standard guitar G without causing a hindrance to the use or function of a standard guitar G.

Those skilled in the art will recognize that the use of levers specifically is not necessary; any arrangement operable to provide a scaling of motion to a sufficient ratio will suffice. Similarly, the use of springs specifically is not necessary; any tensioning arrangement sufficient to store and return sufficient potential energy as needed to create a moment of inertia greater than the weight of guitar G and cause the device as a whole to return to its neutral position when not in use will suffice. Similarly, the use of a flexible control cable specifically is not necessary; any means of transferring motion from one lever to the other that is of sufficient strength to accept the loads required by the devices as a whole will suffice. Those skilled in the art will recognize different numbers, placements, dimensions, and configurations of means of scaling motion, tensioners, and means of transferring motion can be applied to produce similar benefits and produce a similar utility in a similar way, without departing from the spirit of the invention, of which the forgoing is merely a specific embodiment being provided to describe aspects of the broader invention.

The shoulder strap controlled pitch changing means for stringed instruments 100 may be made of steel or any other sufficiently rigid material such as aluminum, high-strength plastic, carbon composite materials and the like. Further, the various components of the shoulder strap controlled pitch changing means for stringed instruments 100 may be made of different materials, and my vary in thickness.

Operation of a Specific Embodiment of the Invention

Shoulder strap controlled pitch changing means for stringed instruments 100 is operable to change the pitch of string W without the use of the users fretting or picking fingers. To achieve this end, shoulder strap S is attached to top lever 200, which is in turn attached to cable assembly 500, which is attached to lower lever 700, which is attached to string W. When activated, top lever 200 pivots about its attachment to top lever baseplate 300 and pulls cable 504, which causes lower lever 700 to pivot about its connection to lower baseplate 600 and change the pitch of sting W by pulling on it and increasing its tension.

A user activates shoulder strap controlled pitch changing means for stringed instruments 100 by pushing guitar G downward. Shoulder strap S, being placed over the shoulder of a user does not move with guitar G in this motion as such pulls upper lever 200 about its pivot point, activating the rest of the device. A user turns tuning bolt 624 until the position of the end of the skank portion of said tuning bolt 624 is suitable to impede the travel of lower lever 700 when a desired tension of string W is reached, thus setting the upper pitch at-which string W will arrive when the string bender apparatus is actuated fully. A user turns thumbscrew 902 to selectively move tuning screw 908 into and out of the intervening space between lower lever 700 and tuning bolt 624, and thus further impedes the travel of lower lever 700, thus impeding the continued tensioning of string W, thus setting an alternative upper pitch at-which string W will arrive when the string bender apparatus is actuated fully.

An advantage of the present invention include, without limitation, that this device can be retrofitted onto an existing electric or acoustic guitar with no modification to the body of the guitar and can be removed from an electric or acoustic guitar having left no damage or indication of its former presence. Furthermore, the invention provides the benefits of strap button control whereas other inventions that provide similar non-invasive installation do not.

While the foregoing written description of illustrative embodiments of the invention enables one of ordinary skill to make and use what the inventor presently considers to be the best mode thereof, those of ordinary skill will understand and appreciate the existence of variations, combinations, and equivalents of these specific embodiments, methods, and examples herein. The invention should therefore not be limited to the above described embodiments, methods, and examples, but comprises all embodiments and methods within the scope and spirit of the invention.

What is claimed is:

1. A string bender apparatus, mountable to a string instrument having a body with a plurality of existing and a plurality of tensioned strings respectively intonated by a plurality of intonation bolts, for varying a pitch of one or more of the tensioned strings, said string bender apparatus comprising:

a pulling means, operable to transmit motion of a string instrument relative to its user to an apparatus;

at least one plate, removably mountable to an outer surface of a string instrument via at least one of the plurality of existing openings;

at least one lever, pivotally attached to said plate or plates, said lever or levers including string engagement means for connecting at least one string instrument string thereto, operable to vary the tension of said string by pivoting said lever or levers relative to said plate or plates, said lever or levers including attachment means, operable to removably connect said pulling means thereto;

at least one tensioner, abutting portions of said lever or levers and said plate or plates, operable to provide resistance to said string bender apparatus, and wherein said plate or plates is adapted to accept respective shank portions of the plurality of intonation bolts, whereby the plate or plates is operable to function as a bridge assembly for the string instrument to set the intonation of the tensioned strings.

2. An apparatus as claimed in claim 1, wherein the allowed travel of the lever or levers is adjustable.

3. An apparatus as claimed in claim 2, further comprising a tuning bolt, attached to said plate or plates, operable to adjustably impede the travel of said lever or levers.

4. An apparatus as claimed in claim 2, wherein a plurality of travel distances of said lever or levers may be adjusted, set, and switched between.

5. An apparatus as claimed in claim 4, further comprising an interval switching means, attached to said lever or levers, operable to adjust, set, and switch between said plurality of travel distances of said levers.

6. An apparatus as claimed in claim 1, further comprising attachment means attached to said plate of plates, operable to removably connect said pulling means thereto.

7. An apparatus as claimed in claim 1, wherein the mechanical advantage of said lever or levers is adjustable.

8. An apparatus as claimed in claim 1, wherein said lever or levers further include a control cable assembly, operable to transmit motion between said attachment means and said string engagement means.

9. An apparatus as claimed in claim 1, further comprising a plurality of openings in said plate or plates, sized to slidably accept shank portions of connecting elements and abut head portions of said connecting elements, located to be suitably aligned with existing openings on a string instrument, operable to removably attach said plate or plates to a string instrument.

10. A string bender apparatus, mountable to a string instrument having a plurality of tensioned strings, the string instrument body being provided with a plurality of existing openings, for varying a pitch of one or more strings of a string instrument, said string bender apparatus comprising:

a pulling means, operable to transmit motion of a string instrument relative to its user to an apparatus;

at least one plate, removably mountable to an outer surface of a string instrument;

at least one lever, pivotally attached to said plate or plates, said lever or levers including string engagement means for connecting at least one string instrument string thereto, operable to vary the tension of said string by pivoting said lever or levers relative to said plate or plates, said lever or levers including attachment means, operable to removably connect said pulling means thereto;

at least one tensioner, abutting portions of said lever or levers and said date or plates, operable to provide resistance to said string bender apparatus, and at least one hollow intonation bolt, located along the path of said string instrument string or strings, operable to slidably pass said string instrument string or strings from said string engagement means of said lever or levers to a bridge assembly.

11. A string bender apparatus, mountable to a string instrument having a plurality of tensioned strings, the string instrument body being provided with a plurality of existing openings, for varying a pitch of one or more strings of a string instrument, said string bender apparatus comprising:

a pulling means, operable to transmit motion of a string instrument relative to its user to an apparatus;

a plurality of plates, removably mountable to an outer surface of a string instrument;

a plurality of levers, pivotally attached to said plates, said levers including string engagement means for connecting at least one string instrument string thereto, operable to vary the tension of said string by pivoting said lever or levers relative to said plates, said levers including attachment means, operable to removably connect said pulling means thereto;

at least one tensioner, abutting portions of said lever or levers and said plate or plates, operable to provide resistance to said string bender apparatus, and further comprising an upper plate, removably mountable to an outer surface of a string instrument, having an opening, sized to slidably accept shank portions of connecting elements and abut head portions of said connecting elements, located to be suitably aligned with existing openings on a string instrument, operable to removably attach said plate to a string instrument, said plate also having an opening, sized to slidably accept shank portions of a control cable conduit and abut head portions of said control cable conduit.

12. What is claimed in claim 11, further comprising an upper lever, pivotally attachable to said upper plate, operable to engage a second lever by pivoting said upper lever relative to said upper plate, said lever including attachment means, operable to removably connect said pulling means thereto, said lever also including an additional attachment means, operable to removably connect a control cable thereto.

13. What is claimed in claim 12, further comprising an lower plate, removably mountable to an outer surface of a string instrument, having a plurality of openings, sized to slidably accept shank portions of connecting elements and abut head portions of said connecting elements, located to be suitably aligned with existing openings on a string instrument, operable to removably attach said plate to a string instrument, said plate also having an opening, sized to slidably accept connector portions of a control cable assembly and abut head portions of said control cable assembly.

14. What is claimed in claim 13, further comprising a lower lever, pivotally attachable to said lower plate, said lever including string engagement means for connecting at least one string instrument string thereto, operable to vary the tension of said string by pivoting said lever relative to said plate, said lever including attachment means, operable to removably connect a control cable thereto.

15. An apparatus as claimed in claim 14, further comprising a control cable assembly, operable to transmit motion between said upper lever and said lower lever, said control cable assembly comprising:

a cable, removably attachable to said upper and lower levers;

a conduit through which the cable passes, operable to guide said cable;

an upper connector, removably attachable to said upper plate;

a lower connector, removeably attachable to said lower plate.

16. An apparatus as claimed in claim 11, wherein the allowed travel of the levers is adjustable.

17. An apparatus as claimed in claim 11, further comprising a tuning bolt, attached to one of said plates, operable to adjustably impede the travel of said levers.

18. An apparatus as claimed in claim 11, wherein a plurality of travel distances of said levers may be adjusted, set, and switched between.

19. An apparatus as claimed in claim 18, further comprising an interval switching means, attached to said levers, operable to adjust, set, and switch between said plurality of travel distances of said levers.

20. An apparatus as claimed in claim 11, further comprising attachment means attached to said plates, operable to removably connect said pulling means thereto.

21. An apparatus as claimed in claim 11, further comprising a string instrument bridge assembly, operable to receive an end of one or more string instrument strings, and to set the intonation of said string instrument string or strings.

22. An apparatus as claimed in claim 21, wherein said bridge assembly is affixed to one of said plates.

23. An apparatus as claimed in claim 11, wherein the mechanical advantage of said levers is adjustable.

24. An apparatus as claimed in claim 11, further comprising at least one hollow intonation bolt, located along the path of said string instrument string or strings, operable to slidably pass said string instrument string or strings from said string engagement means of said levers to a bridge assembly.

* * * * *